US010384863B2

(12) United States Patent
Sylvan

(10) Patent No.: US 10,384,863 B2
(45) Date of Patent: Aug. 20, 2019

(54) APPARATUS FOR BAG STORAGE AND TRANSPORTATION

(71) Applicant: Fineberg+Sylvan LLC, Silver Spring, MD (US)

(72) Inventor: Stephan D. Sylvan, Silver Spring, MD (US)

(73) Assignee: FINEBERG+SYLVAN LLC, Silver Spring, MD (US)

( * ) Notice: Subject to any disclaimer, the term of this patent is extended or adjusted under 35 U.S.C. 154(b) by 198 days.

(21) Appl. No.: 15/104,232

(22) PCT Filed: Dec. 12, 2014

(86) PCT No.: PCT/US2014/070082
§ 371 (c)(1),
(2) Date: Jun. 13, 2016

(87) PCT Pub. No.: WO2015/089435
PCT Pub. Date: Jun. 18, 2015

(65) Prior Publication Data

US 2016/0318700 A1 Nov. 3, 2016

Related U.S. Application Data

(60) Provisional application No. 61/915,713, filed on Dec. 13, 2013.

(51) Int. Cl.
*B65D 25/22* (2006.01)
*B65D 85/00* (2006.01)
(Continued)

(52) U.S. Cl.
CPC ..... *B65D 85/70* (2013.01); *A47G 29/08* (2013.01); *B65D 25/22* (2013.01); *B65D 25/282* (2013.01); *B65D 25/54* (2013.01)

(58) Field of Classification Search
USPC ..... 206/554, 806; 220/751, 752, 769, 772
See application file for complete search history.

(56) References Cited

U.S. PATENT DOCUMENTS 3,142,435 A * 7/1964 Stange ..... B65D 33/12 206/554
4,871,100 A 10/1989 Posner
(Continued)

FOREIGN PATENT DOCUMENTS

GB 2302680 A 1/1997

OTHER PUBLICATIONS

International Search Report dated Apr. 1, 2015, issued in International Application No. PCT/US2014/070082.
(Continued)

*Primary Examiner* — Jacob K Ackun
(74) *Attorney, Agent, or Firm* — Steptoe & Johnson LLP

(57) ABSTRACT

An apparatus for quickly, easily, and securely storing, organizing, and transporting bags may include a front surface, a back surface, side surfaces, and a bottom surface. The apparatus may include a mounting hook projecting outwardly from the back surface. The mounting hook may be configured to attach to one or more objects, such as a pocket on the seat of a vehicle or a shopping cart. The apparatus may include handles for transporting the bags between a store and a vehicle.

7 Claims, 24 Drawing Sheets

(51) Int. Cl.

| | |
|---|---|
| ***A47G 29/08*** | (2006.01) |
| ***B65D 25/28*** | (2006.01) |
| ***B65D 25/54*** | (2006.01) |

(56) References Cited

U.S. PATENT DOCUMENTS

| | | | | | |
|---|---|---|---|---|---|
| 5,031,808 | A * | 7/1991 | Dolenc | B60R 7/046 | 224/280 |
| 5,097,975 | A * | 3/1992 | Waterston | B65F 1/00 | 206/806 |
| 5,182,895 | A * | 2/1993 | Lugo | A45C 3/04 | 206/459.5 |
| 5,201,439 | A * | 4/1993 | Davies | B44D 3/126 | 206/361 |
| 5,299,683 | A * | 4/1994 | Poole | A47K 3/281 | 132/315 |
| 5,386,910 | A * | 2/1995 | Liss | A47G 29/00 | 206/554 |
| 6,050,408 | A * | 4/2000 | Testa | A46B 17/04 | 206/15.2 |
| 6,053,340 | A * | 4/2000 | Cameron | A47B 81/00 | 211/75 |
| 6,076,700 | A * | 6/2000 | Manges | B65D 25/22 | 220/23.4 |
| 6,152,407 | A * | 11/2000 | McKenzie | B65B 67/1227 | 248/95 |
| 7,147,129 | B1 * | 12/2006 | Menefield | A61F 6/005 | 221/283 |
| 7,992,728 | B2 * | 8/2011 | Burgess | A47F 5/0056 | 211/126.15 |
| 8,011,500 | B2 * | 9/2011 | Lee | A45C 3/04 | 206/216 |
| 2003/0146220 | A1 * | 8/2003 | Kaura | A01K 5/01 | 220/481 |
| 2004/0112850 | A1 | 6/2004 | Jordan | | |
| 2009/0223954 | A1 * | 9/2009 | Kellogg | D06F 95/002 | 220/6 |
| 2010/0021088 | A1 * | 1/2010 | Wilfong, Jr. | B65D 33/02 | 383/23 |
| 2011/0168765 | A1 * | 7/2011 | Hoyord | A45C 3/04 | 229/92.8 |
| 2012/0121212 | A1 * | 5/2012 | Decker | B65F 1/006 | 383/33 |
| 2017/0156461 | A1 * | 6/2017 | Chaffee | A45C 3/04 | |

OTHER PUBLICATIONS

Written Opinion of the International Searching Authority dated Apr. 1, 2015, issued in International Application No. PCT/US2014/070082.

Smiley face plastic bag dispenser.thisnext.Mar. 20, 2011 [retrieved on Feb. 24, 2015]. Retrieved from the internet: <URL: https://web.archive.org/web/20110320102326/http://www.thisnext.com/item/26A7A1FC/SMILEY-FACE-PLASTIC-BAG>.

Notification Concerning Transmittal of International Preliminary Report on Patentablility (Chapter I of the Patent Cooperation Treaty) dated Jun. 23, 2016, issued in International Application No. PCT/US2014/070082.

* cited by examiner

APPARATUS FOR BAG STORAGE AND TRANSPORTATION

CLAIM OF PRIORITY

This application claims the benefit under 35 USC 371 to International Application No. PCT/US 2014/070082, filed Dec. 12, 2014, which claims priority to U.S. Provisional Patent Application No. 61/915,713, filed Dec. 13, 2013, each of which is incorporated by reference in its entirety.

FIELD OF THE INVENTION

The exemplary embodiments of the invention relate generally to an apparatus for organizing, storing and transporting bags.

BACKGROUND OF THE INVENTION

There has been a rapid increase in consumers bringing their own bags to stores when shopping. This is has been caused by (1) a surge in local, state, regional, and national bans or fees on disposable plastic and other single-use bags, (2) growing recognition of the utility of strong, reusable bags, (3) a surge in concerns about the environmental costs and risks associated with single-use bags; (4) growing concerns about the public costs of bag disposal, and (5) and concerns by retailers about the costs associated with single-use bags. The rapid increase in consumers purchasing and bringing their own reusable bags to stores has caused a series of new challenges, including (1) consumers becoming upset when they forget their reusable bags at home (which essentially requires them, in an increasing number of jurisdictions, to purchase additional reusable bags they don't need just to get their groceries home), (2) difficulty storing several bags in one place, such as another bag, because generally a bag does not easily stand up or stay open on its own while attempting to stuff it with other bags, (3) bags cluttering homes and vehicles, (4) bags lost in homes and vehicles, (5) bags no longer located in the spot they were placed or no longer visible in the vehicle because the bags were moved by vehicle passengers, packages placed in the vehicle, or the motion of the vehicle, (6) store customers struggling in check-out lines to locate and retrieve their bags out from under piles of products placed in the shopping carts, (7) cashiers and store customers waiting additional time while other store customers locate bags from within a shopping cart, and (8) retailers and grocers experiencing additional costs due to these delays in checkout lines. Accordingly, a need exists for an improved apparatus for storing and transporting bags.

SUMMARY

In accordance with at least one embodiment of the invention, an apparatus storing and/or transporting bags is described. The apparatus may be used to store any type of bags, including plastic, paper, fabric or reusable shopping and/or grocery bags. The apparatus may be made from lightweight, sturdy, flexible, and durable plastic, and from materials with insulating properties, or combinations of these properties. The apparatus may be configured to stand up on a floor on its own and may include a mounting hook that allows it to be quickly, easily and securely mounted to the map/magazine/seat pocket of a vehicle. The mounting hook may also be configured to quickly, easily, and securely hook the apparatus to a shopping cart while an individual is shopping at the store. The mounting hook may also be configured to quickly, easily, and securely hook the apparatus to the types of shopping carts owned by the consumer and transported usually by foot to and from stores.

In at least one embodiment, the apparatus includes a front surface, a back surface, two side surfaces connecting the front and back surface to each other, and a bottom surface that is attached to the front surface, back surface, and two side surfaces. Alternatively, the apparatus may include one contiguous surface in the shape of a bowl, a cone, or a sphere. The apparatus may include one or more handles or straps for transporting the apparatus. The front surface, back surface, and two side surfaces may form an opening in a top portion of the apparatus, which is configured to receive bags. The back surface may include a mounting hook that projects outwardly and extends downward and is configured to attach to another object, such as a grocery cart or a pocket in a vehicle. The front surface, back surface, and side surfaces may include holes to serve as viewing windows or openings to make it easy to see what and how many items may be inside the apparatus. The holes can also be used to stuff reusable bags into the apparatus. Alternatively or in addition, these surfaces may also be made of translucent materials to make it easier to see what and how many items may be inside the apparatus, optionally, without including windows. One or more of the surfaces can be rigid, which means sufficiently rigid to give shape and structure to the apparatus. The rigidity can permit the apparatus to be used as described herein, but is not meant to imply there cannot be some flexibility in the one or more surface.

The mounting hook and handles or straps may be designed to quickly and easily attach and detach to the main body of the apparatus for purposes of (1) saving space in the shipping of the apparatus in the manufacturing supply chain, from manufacturer to retailers or consumers, (2) saving warehouse space, and/or (3) saving retail floor space when displaying the apparatus to consumers.

Objects of the invention include (1) preventing consumers from forgetting to bring their bags into the stores with them, (2) eliminating the difficulty of stuffing multiple bags into a single bag for storage and transport, because it is difficult to stuff bags into another bag because bags generally have little to no structure or ability to stand up on their own, because a bag stuffed with other bags is difficult to transport because it does not stand on its own and because a bag does not easily attach to a vehicle or shopping cart, (3) eliminating bag-related clutter in homes and vehicles, (4) preventing bags from getting lost in homes and vehicles, (5) ensuring a set of bags stays in an intended, convenient location without getting kicked, nudged, or moved to a different part of a vehicle, (6) preventing time wasted locating bags from within a vehicle or shopping cart, because a bag stuffed with other bags is likely to end up at the bottom of a shopping cart, (7) providing a quick and simple means for consumers to give all of their bags to a cashier or employee of a store, and (8) creating an environmentally friendly apparatus to store and transport bags.

Figure 1:
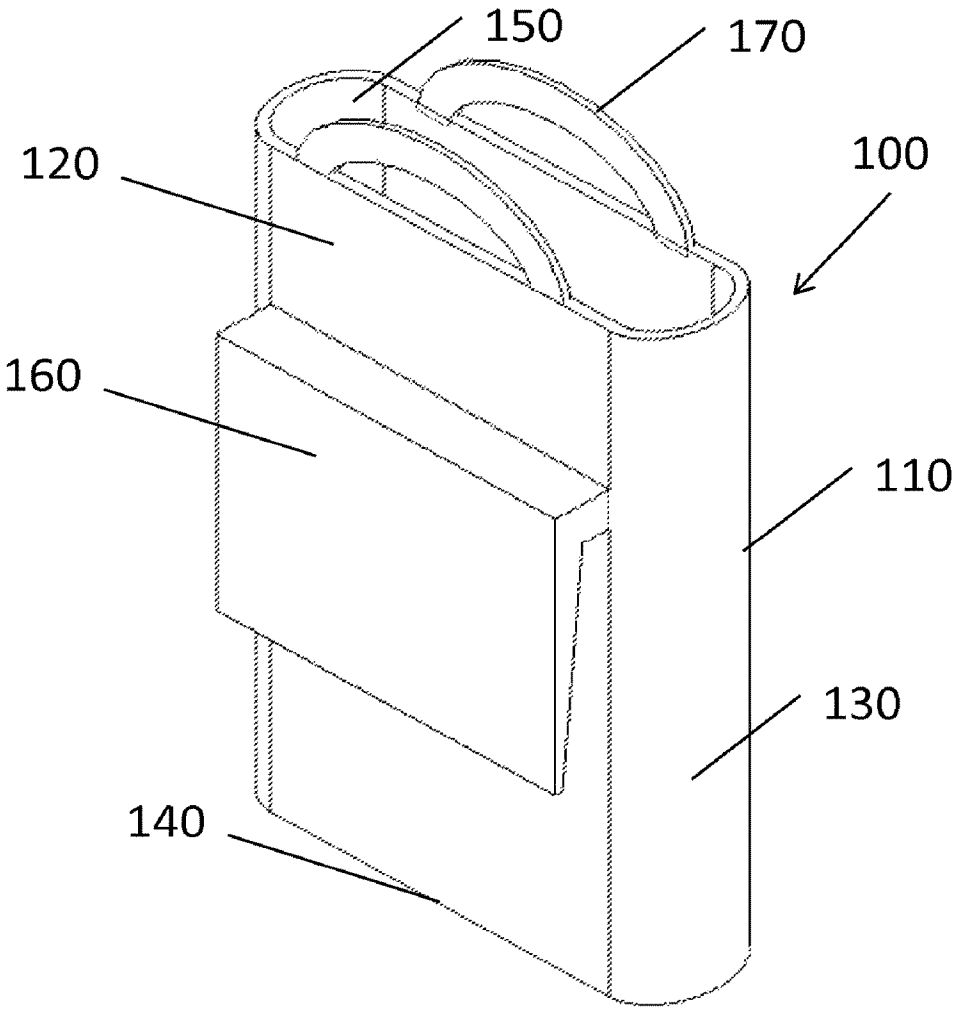
FIG. 1 illustrates a perspective rear view of the bag storage apparatus in accordance with at least one embodiment of the invention.

Before the embodiments of the invention are explained in detail, it is to be understood that the invention is not limited in its application to the details of construction and the arrangement of the components set forth in the following description or illustrated in the drawings. The invention is capable of other embodiments and of being practiced or being carried out in various ways. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, the use of the term "mount," "mounted" or "mounting" is meant to broadly include any technique or method of mounting, attaching, joining or coupling one part to another, whether directly or indirectly.

DETAILED DESCRIPTION

Figure 8:
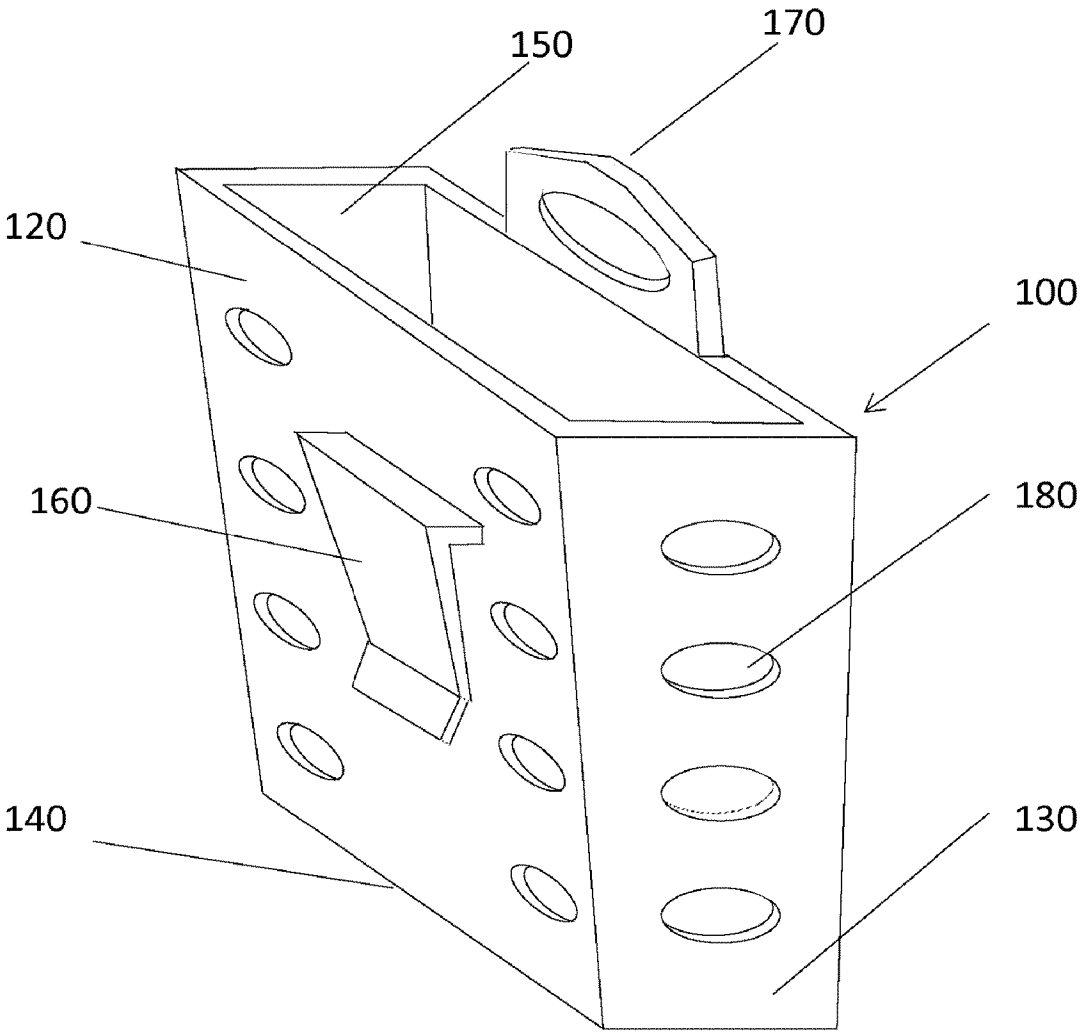
FIG. 8 illustrates a perspective rear view of another embodiment of the bag storage apparatus in accordance with at least one embodiment of the invention.

The invention may be embodied in various forms. Referring to the Figures wherein like numerals indicate like elements, FIGS. 1 and 8 depict an apparatus 100 for storing and transporting bags. The apparatus 100 may store any types of bags, including plastic, paper, textile, single use, or reusable bags. The apparatus 100 may be made of any suitable material. In at least one embodiment, the apparatus 100 may be made of lightweight material, such as plastic. The material may be non-toxic, sturdy, flexible, durable, and insulating. For example, the material can be a polyolefin, such as polypropylene or polyethylene. Alternatively, or in addition, the material can include a fabric, for example a stiffened fabric, a metal, for example aluminum or tin, or a combination of stiff, lightweight materials. In at least one embodiment, the apparatus 100 may be cleaned by household cleaning materials. The apparatus 100 may also be made of a material that withstands hot and cold temperatures and also withstand sun exposure.

Figure 2A:
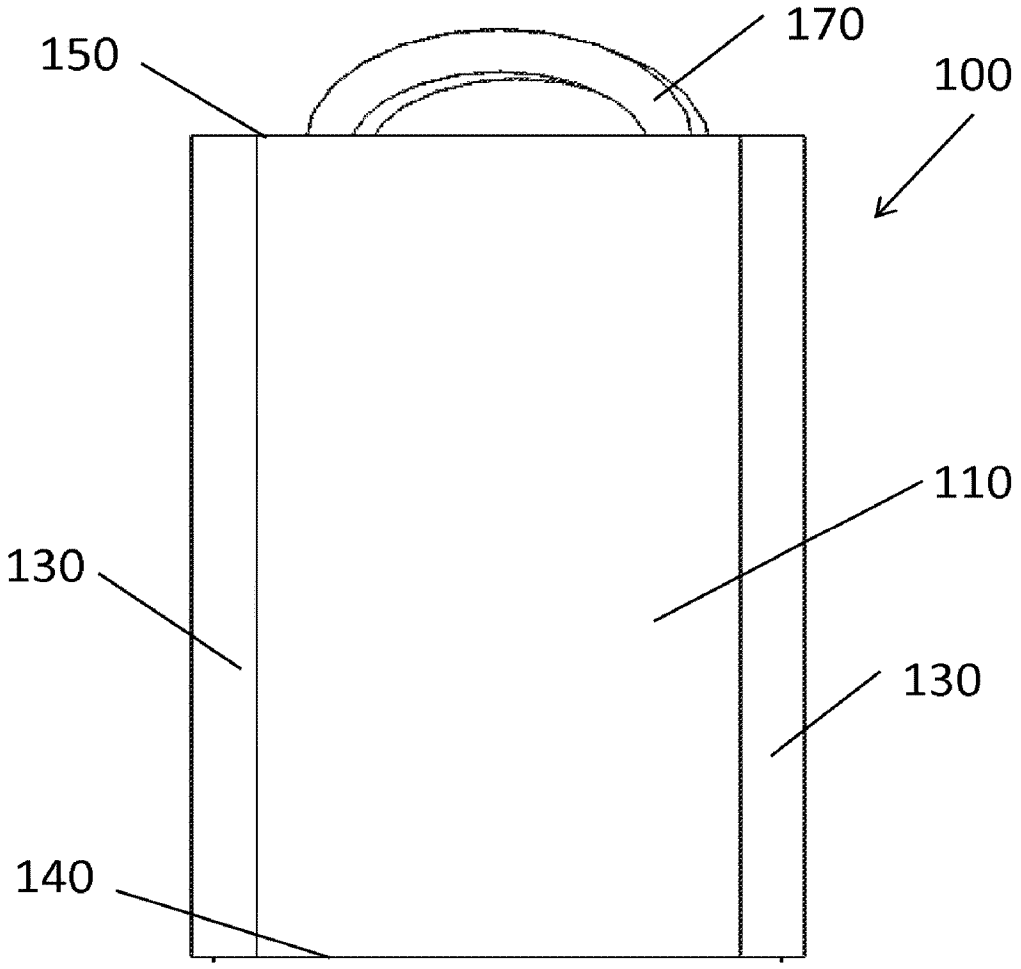
FIGS. 2*a* and 2*b* illustrate front views of the bag storage apparatus in accordance with at least one embodiment of the invention.
Figure 3A:
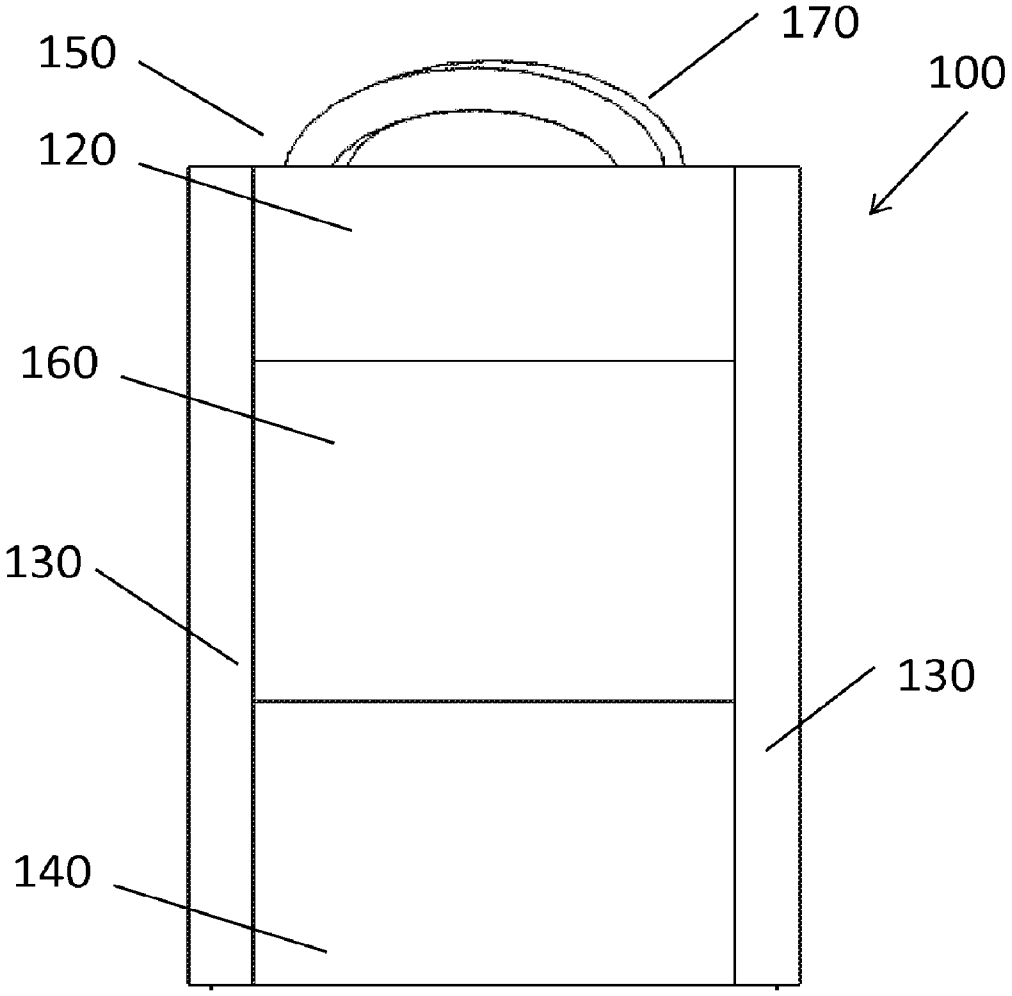
FIGS. 3*a* and 3*b* illustrate rear views of the bag storage apparatus in accordance with at least one embodiment of the invention.
Figure 9A:
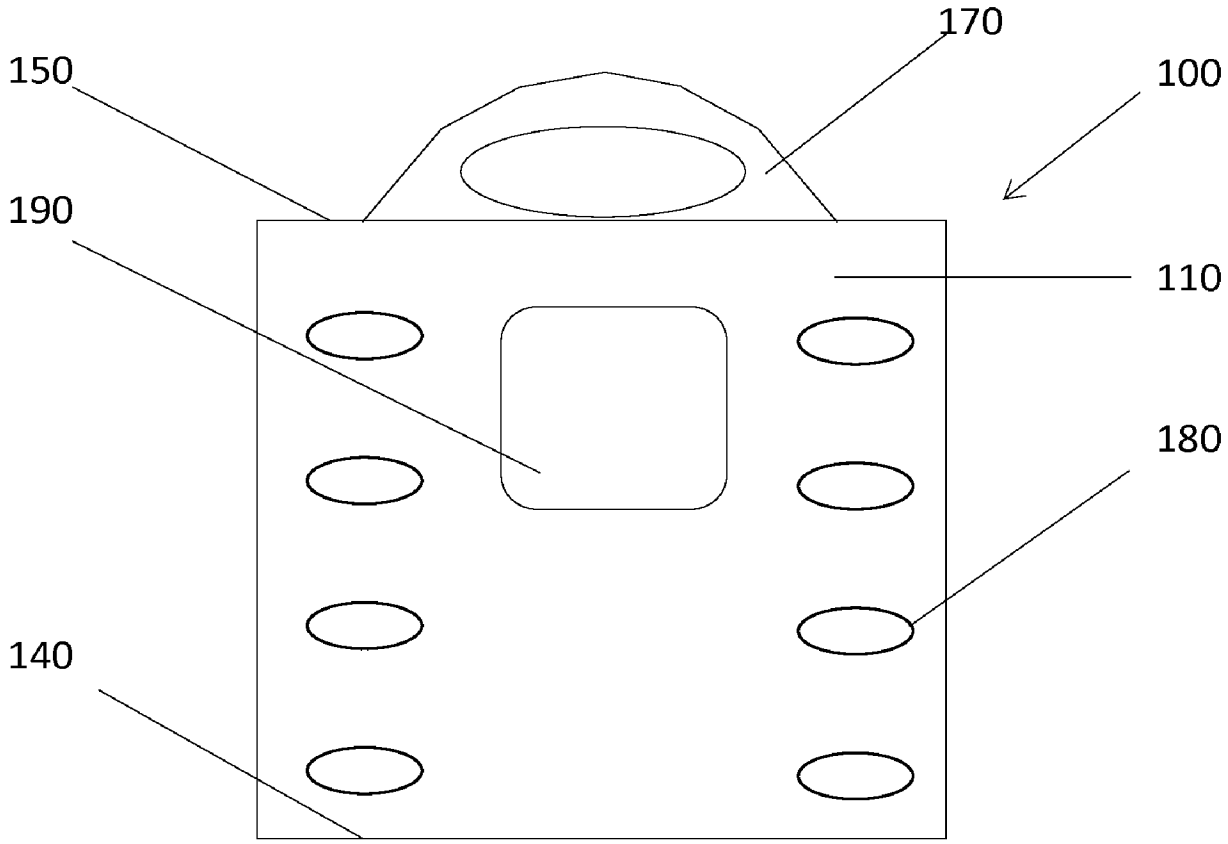
FIGS. 9*a* and 9*b* illustrate front views of another embodiment of the bag storage apparatus in accordance with at least one embodiment of the invention.
Figure 10A:
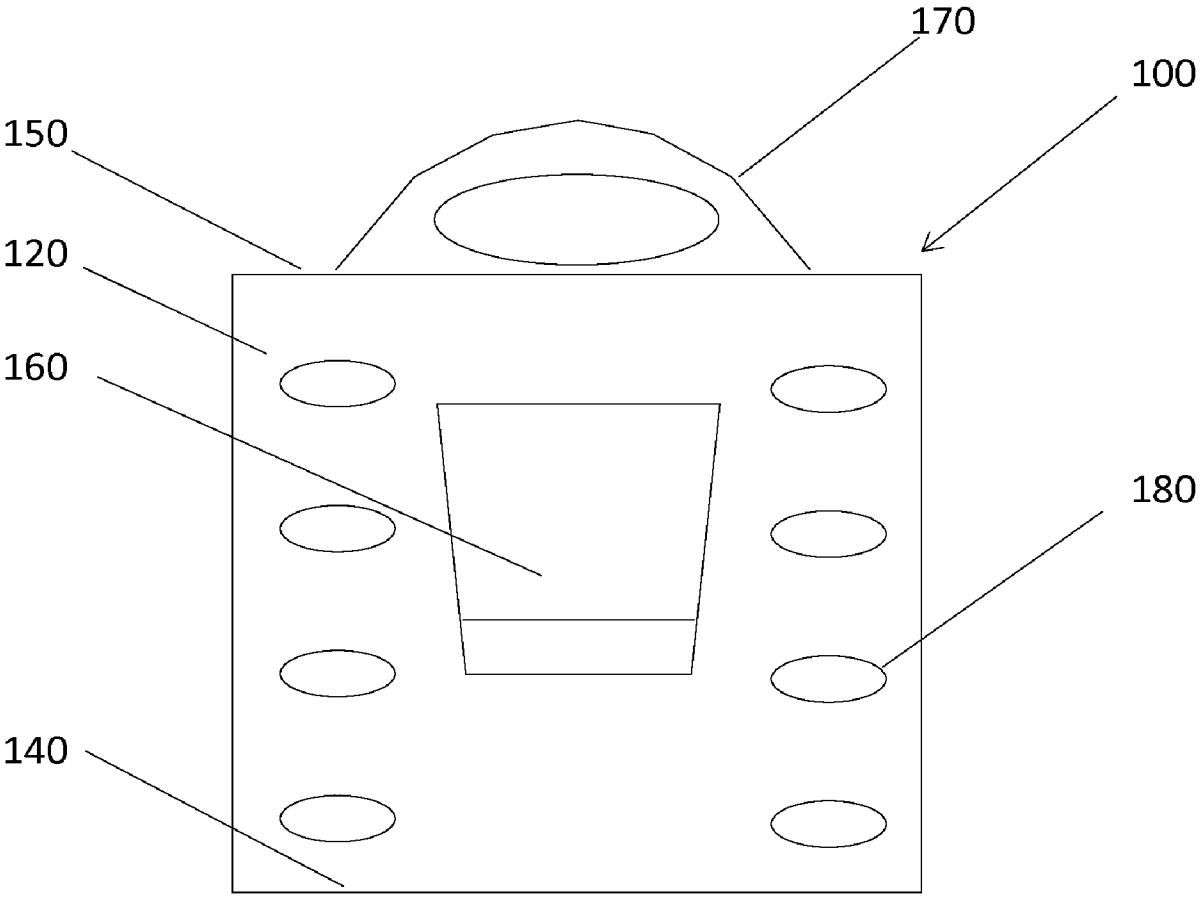
FIGS. 10*a* and 10*b* illustrate rear views of another embodiment of the bag storage apparatus in accordance with at least one embodiment of the invention.

As illustrated in FIGS. 2*a* and 9*a*, the apparatus 100 may include a front surface 110. The front surface 110 may be any shape, such as square or rectangular. The front surface 110 may include a curvature or may be a flat surface. As illustrated in FIGS. 3*a* and 10*a*, the apparatus 100 may include a back surface 120. The back surface 120 may be any shape, such as square or rectangular, and may be the same shape as the front surface 110. The back surface 120 may include a curvature or may be a flat surface.

As illustrated in FIGS. 4*a*, 5, 11*a* and 12, the apparatus may include side surfaces 130. The side surfaces 130 may attach to both the front surface 110 and the back surface 120. The side surfaces 130 may be any shape, including square or rectangular. The side surfaces 130 may be flat or may include a curvature. In at least one embodiment, the side surfaces connect to the front surface 110 and back surface 120 and include a curvature such that no sharp edges exist on the apparatus 100.

Figure 6A:
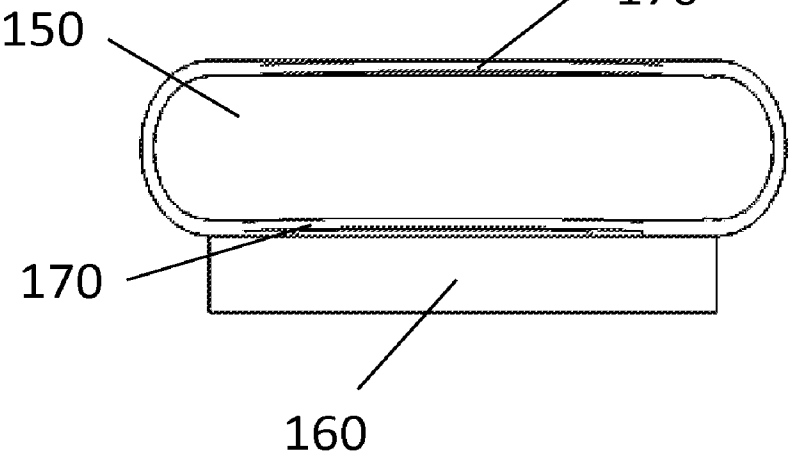
FIGS. 6*a* and 6*b* illustrate top views of the bag storage apparatus in accordance with at least one embodiment of the invention.
Figure 7A:
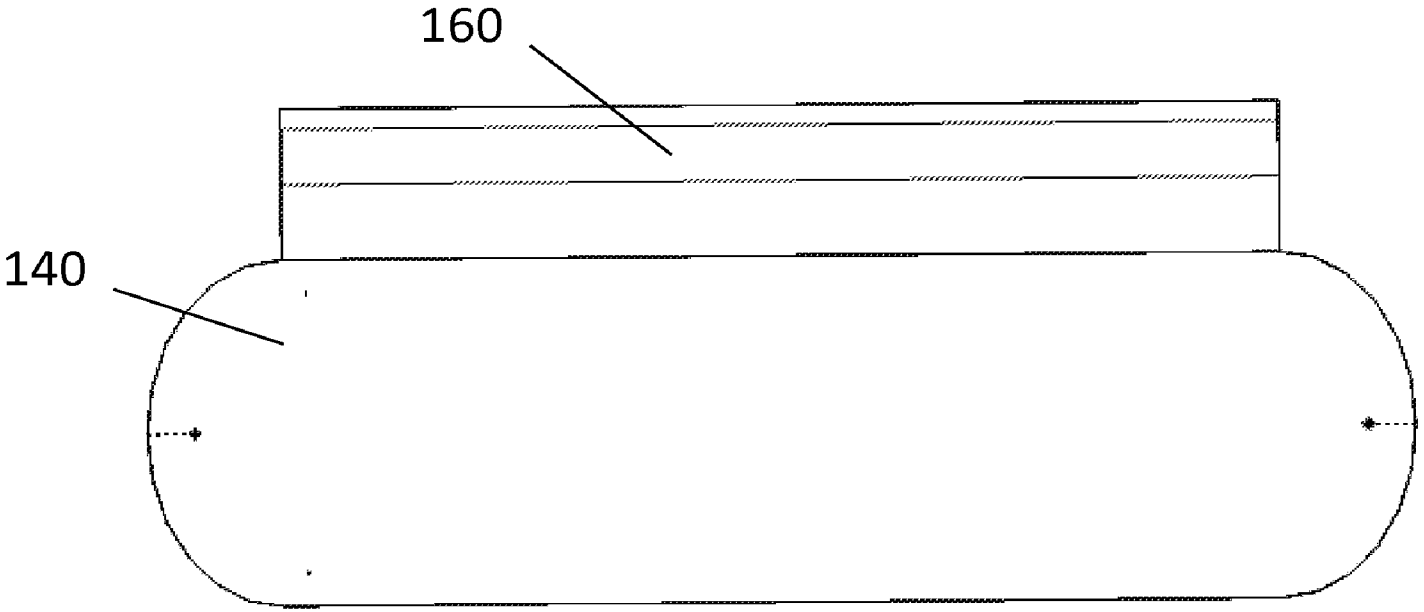
FIGS. 7*a* and 7*b* illustrate bottom views of the bag storage apparatus in accordance with at least one embodiment of the invention.
Figure 13A:
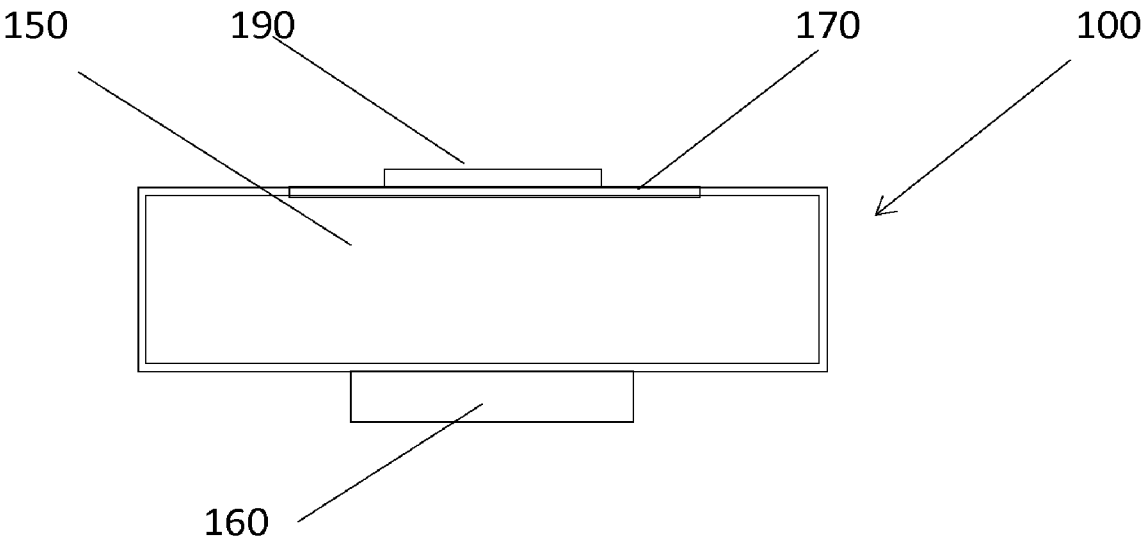
FIGS. 13*a* and 13*b* illustrate top views of another embodiment of the bag storage apparatus in accordance with at least one embodiment of the invention.
Figure 14A:
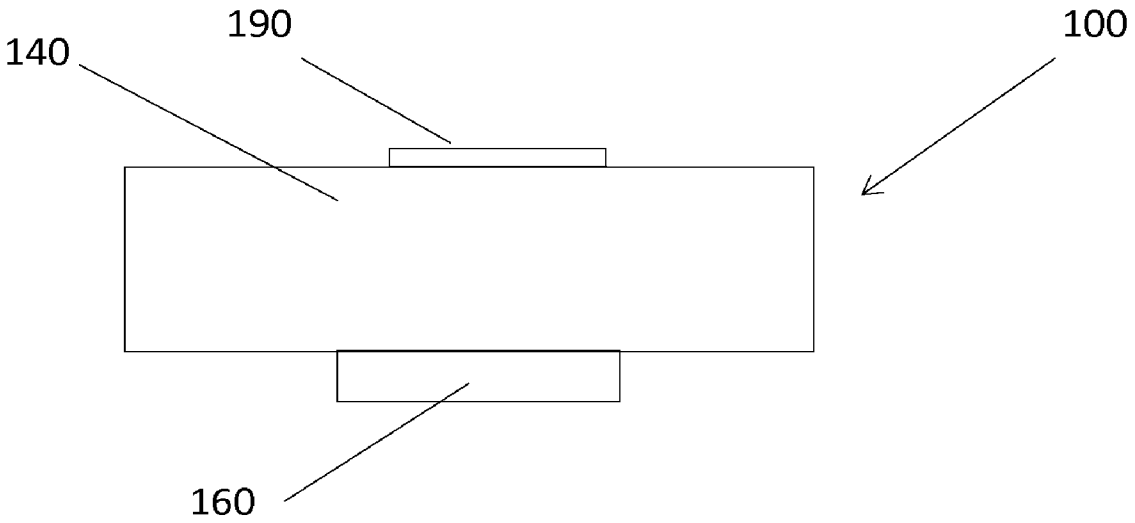
FIGS. 14*a* and 14*b* illustrate bottom views of another embodiment of the bag storage apparatus in accordance with at least one embodiment of the invention.

As illustrated in FIGS. 7*a* and 14*a*, the apparatus 100 may include a bottom surface 140. The bottom surface may attach to the front surface 110, the back surface 120, and two side surfaces 130. As illustrated in FIGS. 6*a* and 13*a*, the apparatus 100 may include an orifice 150 at the top, which is configured to receive bags.

The apparatus 100 may be any suitable shape and size for storing and transporting one or more bags. In at least one embodiment, the apparatus 100 has rounded edges. In another embodiment, the apparatus 100 has square edges. The bottom surface 140 may be a flat surface or may have a shape. In at least one embodiment, the bottom surface 140 is flat such that the apparatus 100 can be placed on a flat surface and stand on its own. In at least one embodiment, the apparatus 100 is formed from one continuous surface. The apparatus 100 may be any shape, such as a box, a sphere, a cone, or a bowl.

Referring back to FIGS. 4*a*, 5, 11*a* and 12, the back surface 120 may include a mounting hook 160. The mounting hook 160 may be any suitable size or shape. In at least one embodiment, the mounting hook 160 extends across the entire width of the back surface 120 of the apparatus 100. In another embodiment, the mounting hook 160 may only extend across a portion of the back surface 120 of the apparatus 100. The mounting hook 160 may project outwardly from the back surface 120 and extend downwardly. The mounting hook 160 may be configured to securely hook onto a pocket of a vehicle and also securely attach to a shopping cart. The mounting hook 160 may be made of the same material as the apparatus 100 or a different material from the apparatus 100.

The apparatus 100 may also include one or more handles or straps 170 that extend from the top edges of the front surface 110, the side surfaces 130, and/or back surface 120. The one or more handles 170 may extend upwardly from top edges of the front surface 110 and/or back surface 120. The handles 170 may be made of any suitable material for holding and transporting the apparatus 100. In at least one embodiment, the handles 170 are made of the same material as the apparatus 100. In another embodiment, the apparatus 100 includes a carrying strap. The carrying strap may be in addition to or in place of the handles 170.

The apparatus 100 may be configured with a holder 190 to display advertisements, to hold paper, to hold recipes or coupons, to hold shopping list, to hold a writing utensil, or to provide a writing surface for shopping or grocery lists or other notes, including an erasable surface. In at least one embodiment, the front surface 110 includes one or more areas to display an advertisement, or to hold paper or other surface for use in creating a shopping list, as illustrated by element 190 in FIGS. 2*a* and 9*a*. The area may be any suitable size or shape, including a square, rectangle, or circle, and may be on a portion of the front surface 110 or may comprise the entire front surface 110. The surfaces 110, 120, 130, and 160 may also be configured to display advertisements, to hold paper, to hold recipes, to hold coupons, to hold a writing utensil, or to provide a writing surface for use in creating a shopping or grocery lists or other notes including an erasable surface. The holder 190 may be configured on either the inside or outside of the surfaces 110, 120, or 130. Additionally, the mounting hook 160 may be configured to display one or more advertisements, to hold paper, to hold recipes, coupons, to hold a writing utensil, or to provide a writing surface for shopping or grocery lists or other notes, including an erasable surface. Holder 190 can include a transparent exterior wall to allow material to be read through the wall when in the holder.

Referring to FIGS. 8, 9*a*, 9*b*, 10*a*, 10*b*, 10*a*, 10*b*, and 11, the front, back and side surfaces 110, 120, and 130 may include viewing windows or openings 180. These viewing windows or openings allow the consumer to see if any and how many bags or other items are contained within the apparatus. The viewing windows or openings 180 may be any suitable size or shape to allow the consumer to determine if and how many bags or other items are contained within the apparatus. The surfaces of the apparatus may also be designed using translucent or transparent materials to make it easier to see what and how many items may be inside the apparatus.

Figure 2B:
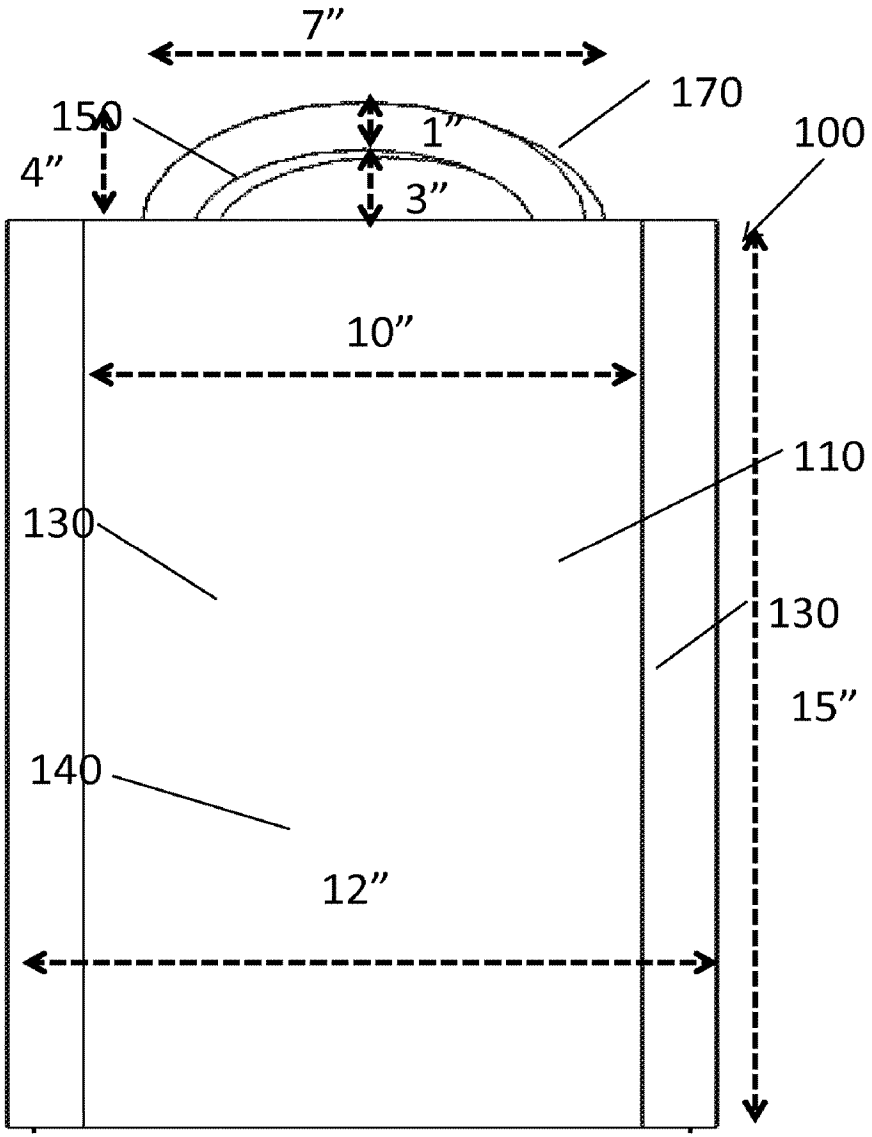
Figure 3B:
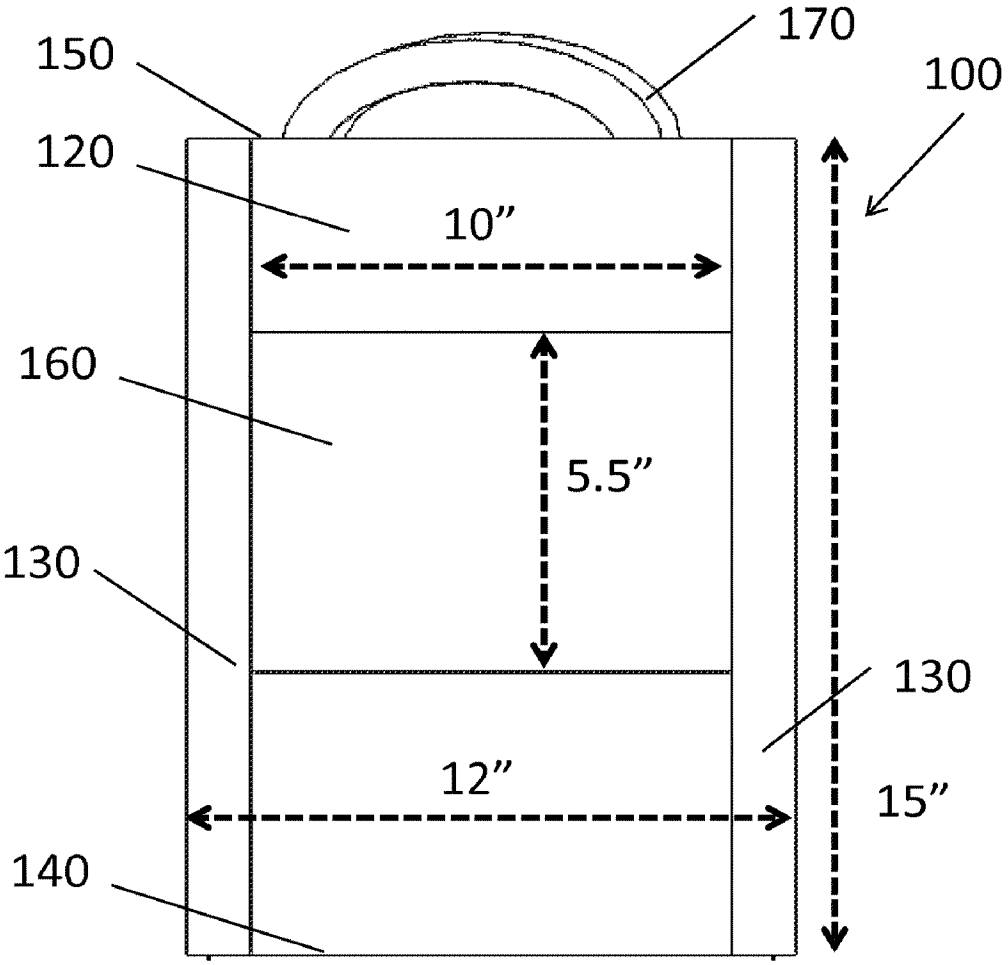
Figure 4A:
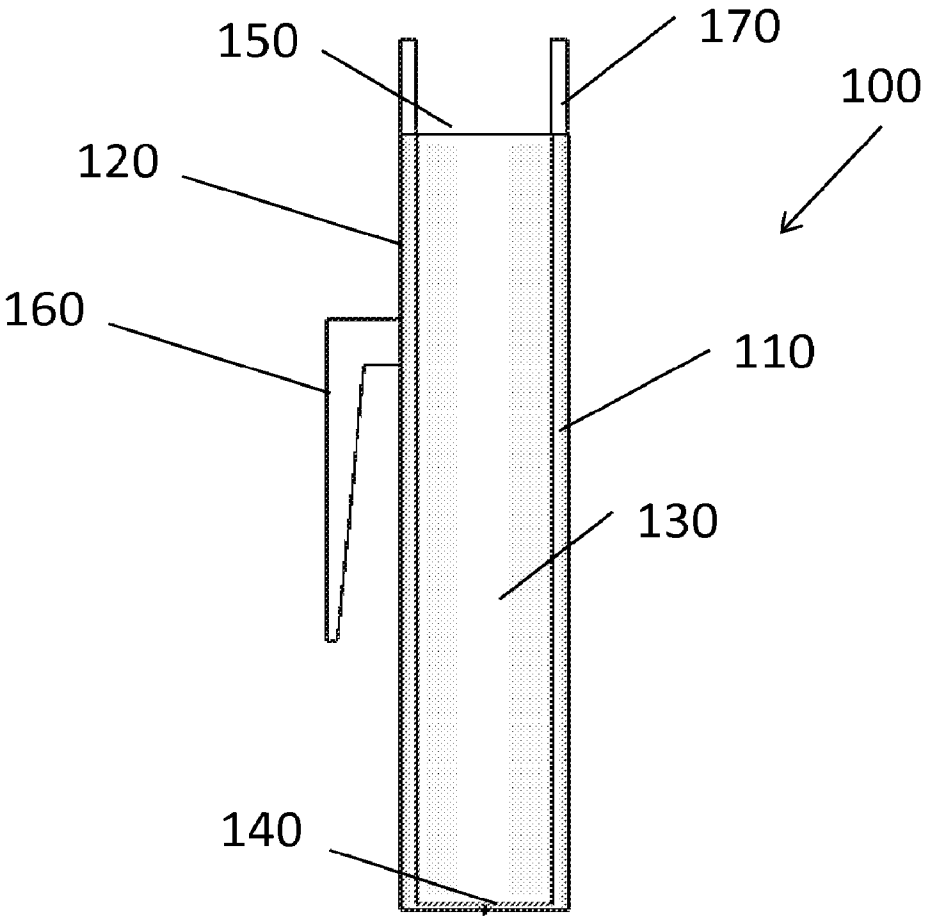
FIGS. 4*a*, 4*b*, and 5 illustrate side views of the bag storage apparatus in accordance with at least one embodiment of the invention.
Figure 4B:
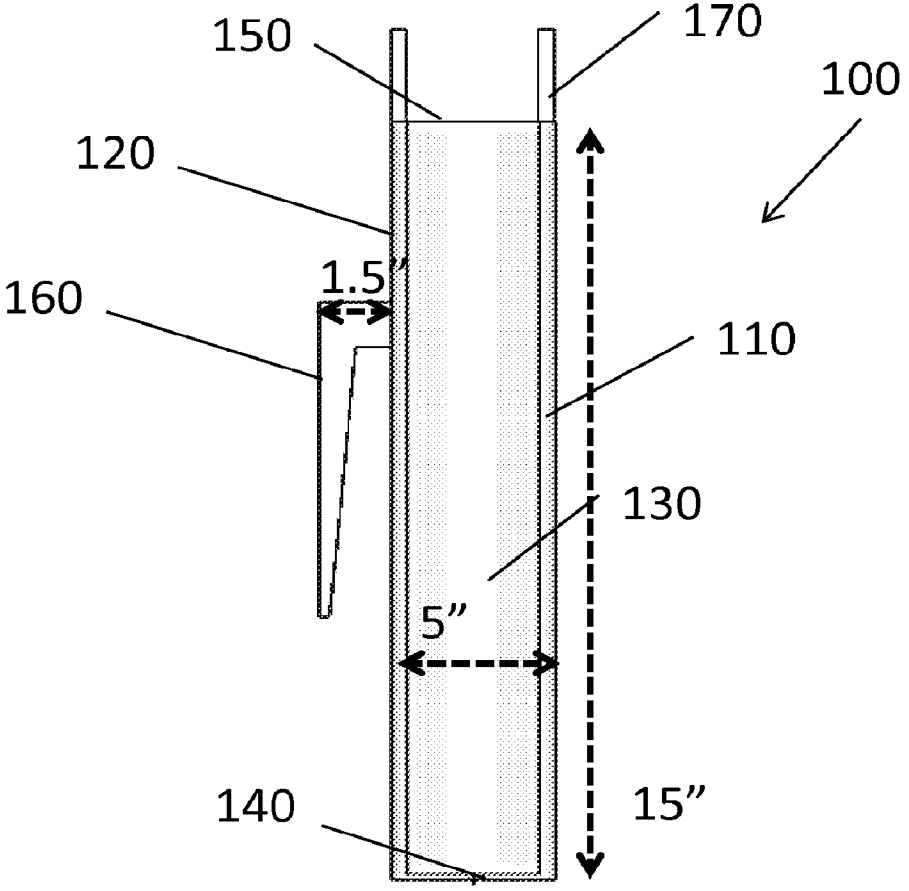
Figure 5:
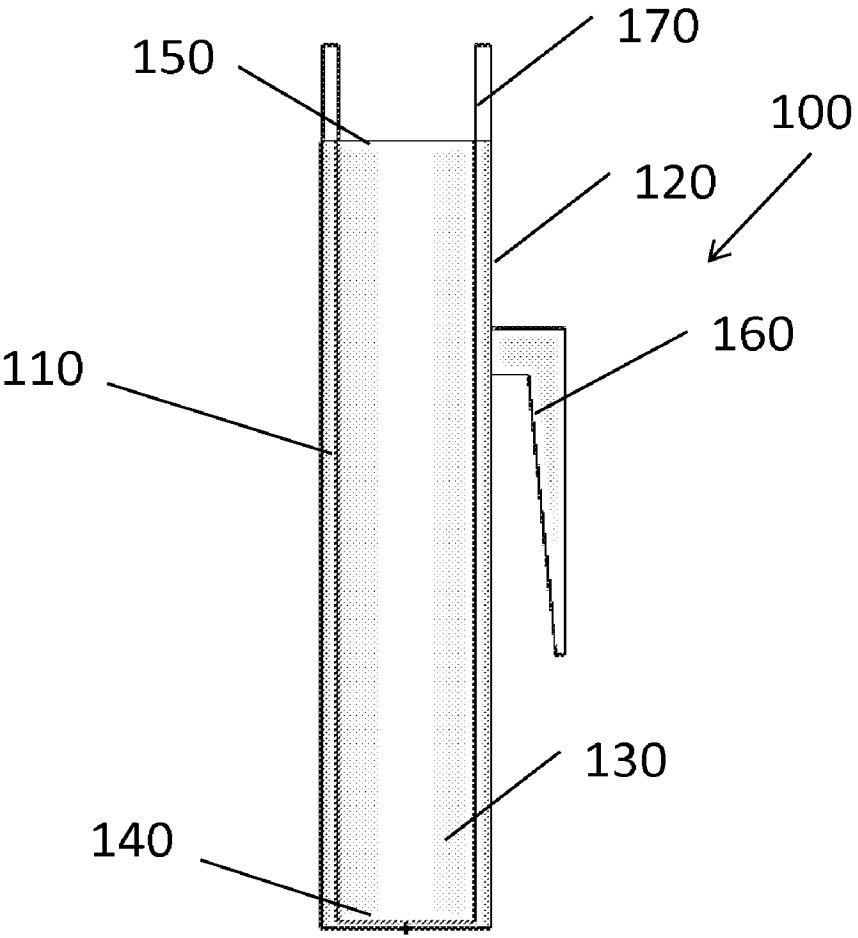
Figure 6B:
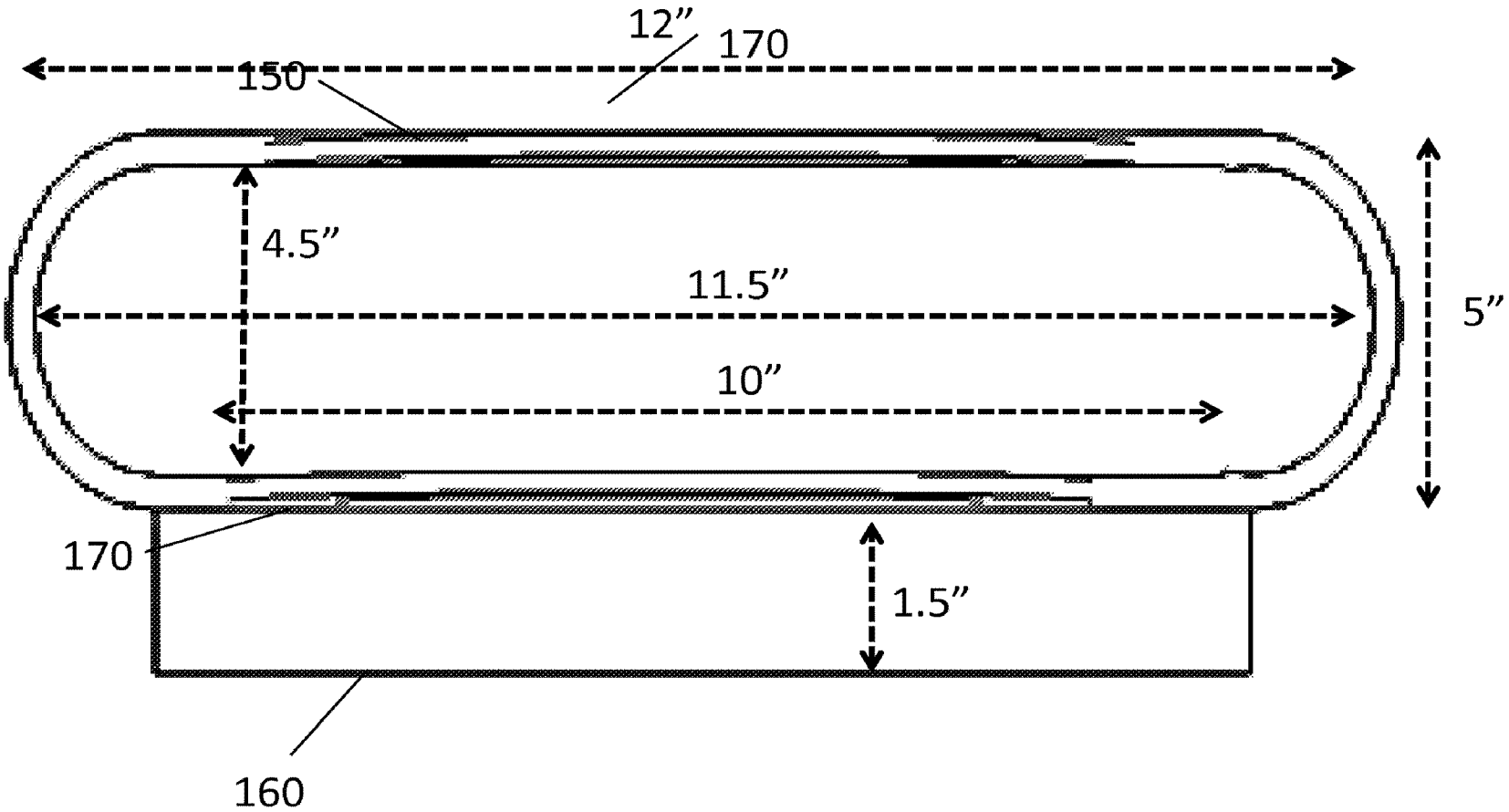
Figure 7B:
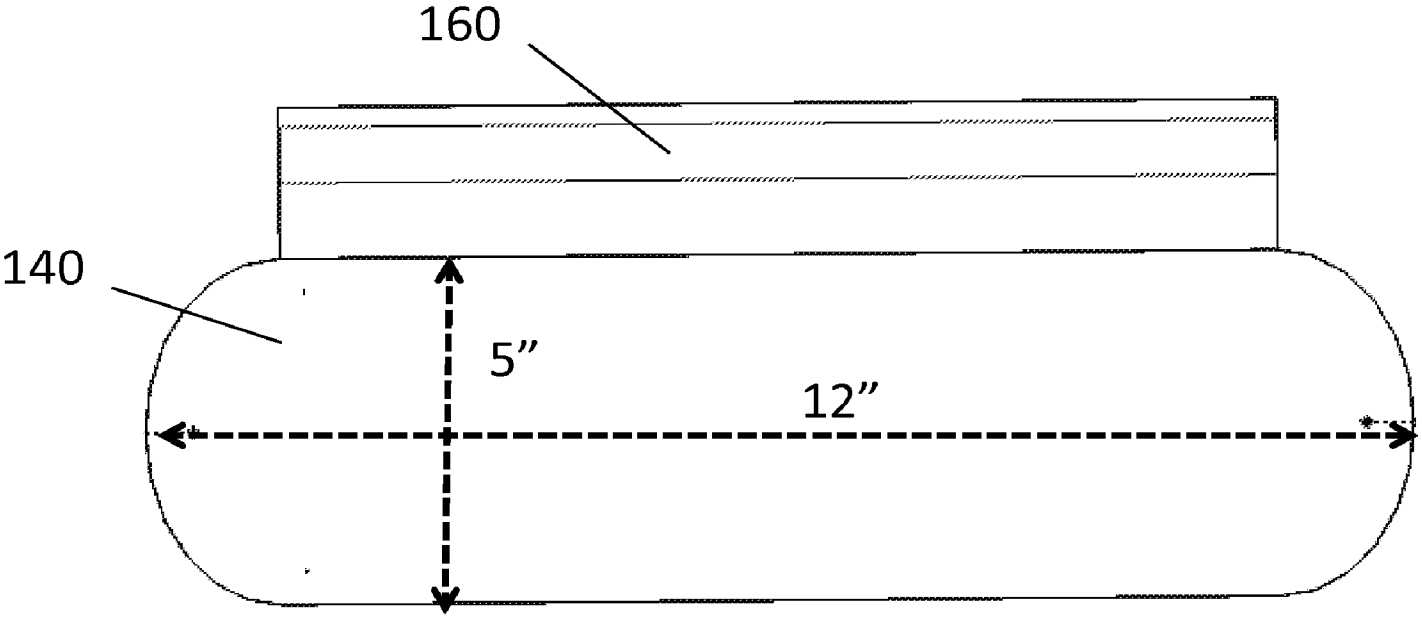
Figure 9B:
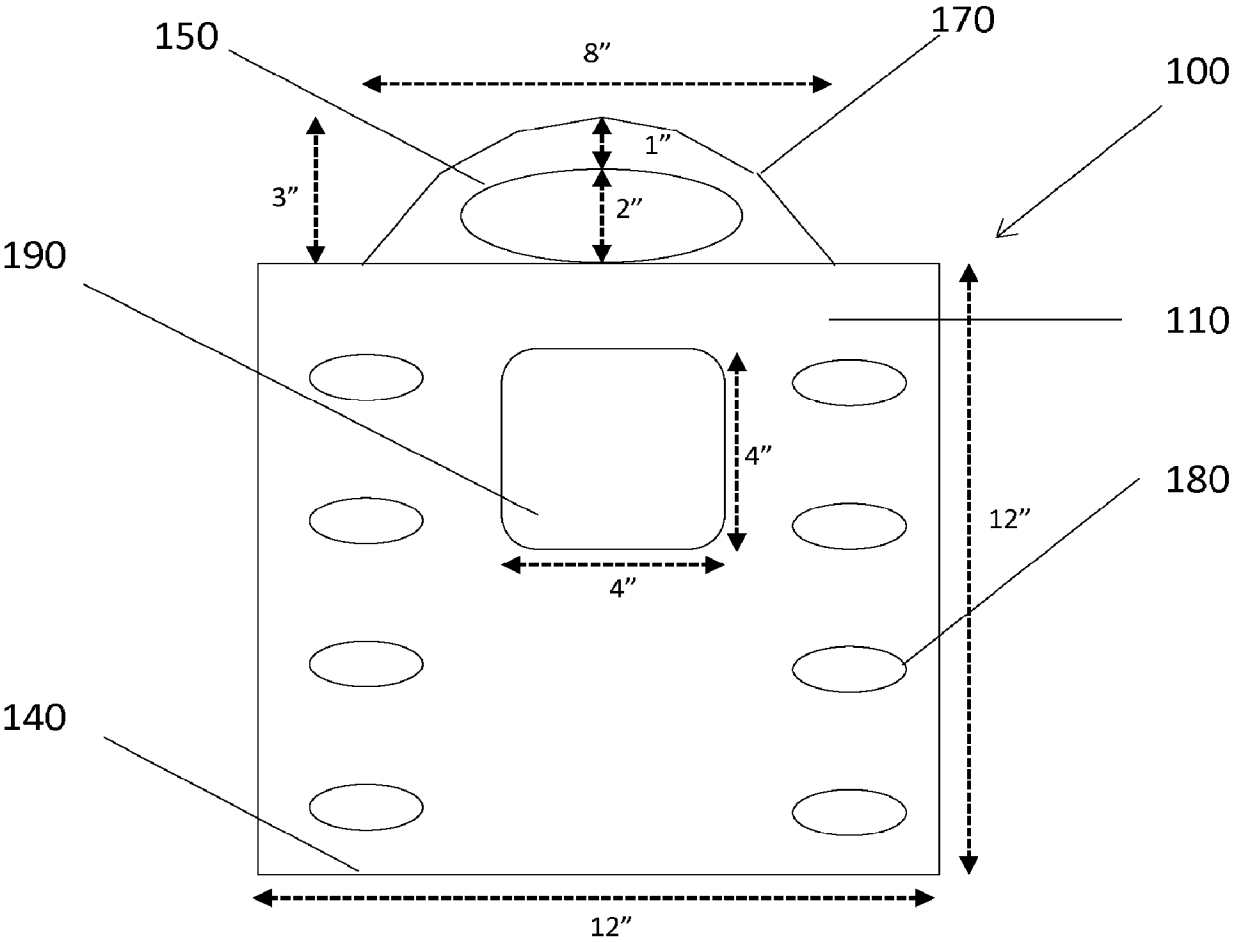
Figure 10B:
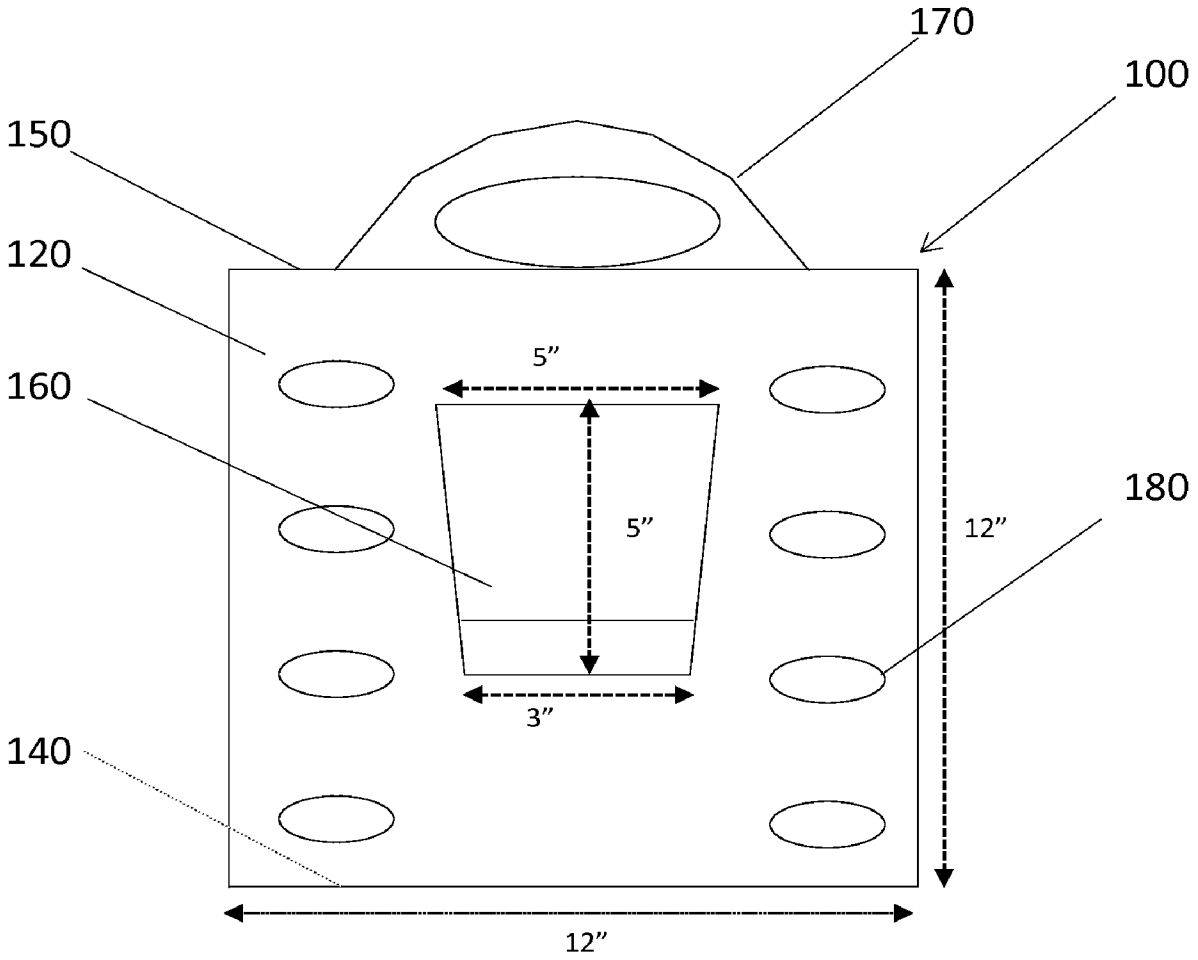
Figure 11A:
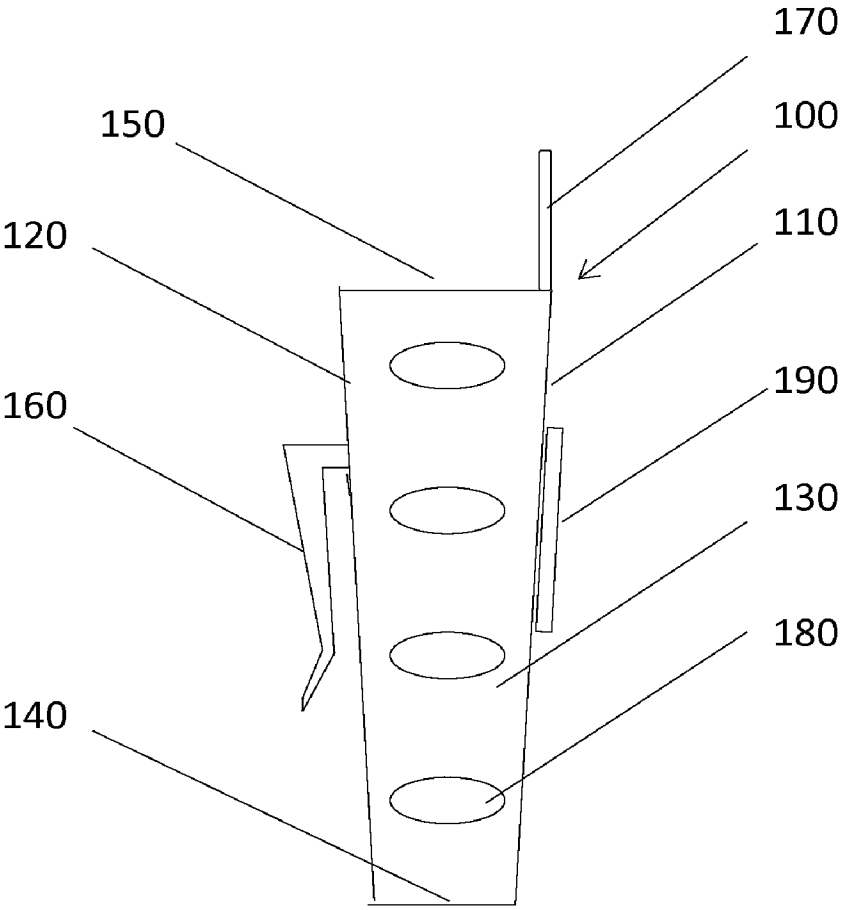
FIGS. 11*a*, 11*b*, and 12 illustrate side views of another embodiment of the bag storage apparatus in accordance with at least one embodiment of the invention.
Figure 11B:
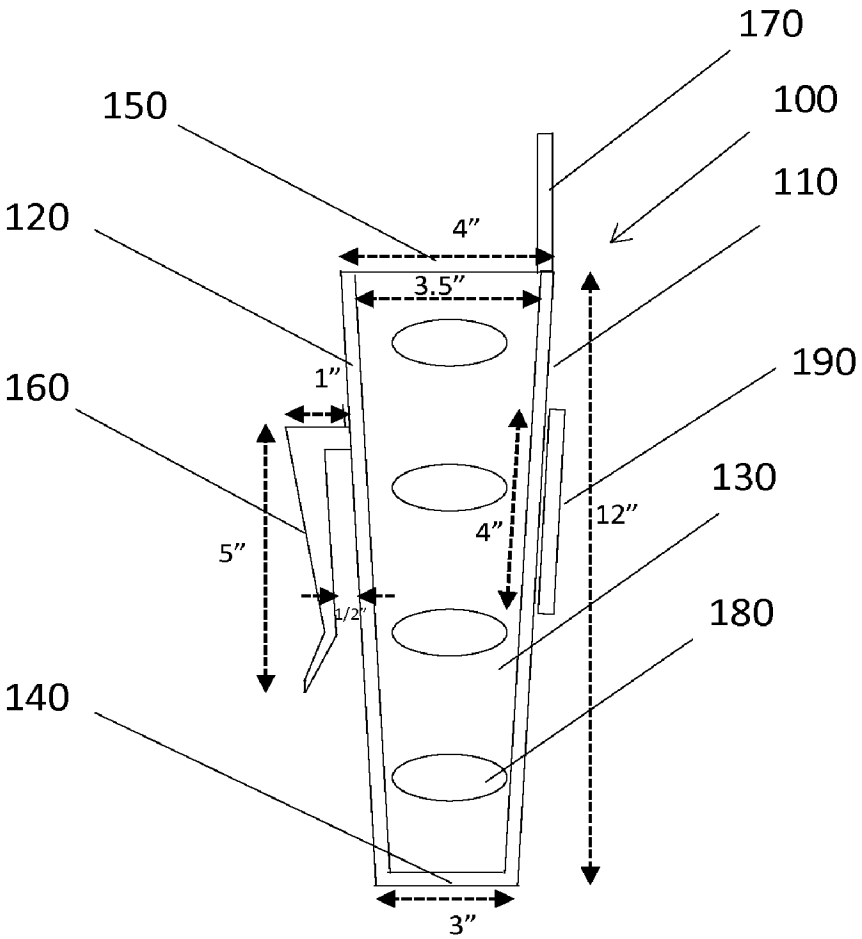
Figure 12:
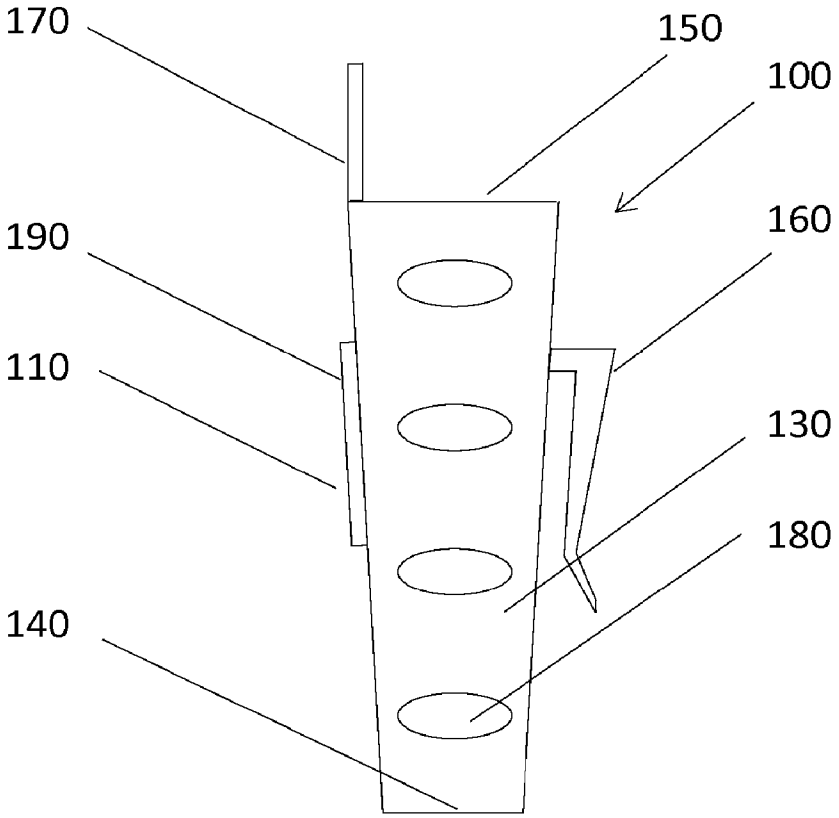
Figure 13B:
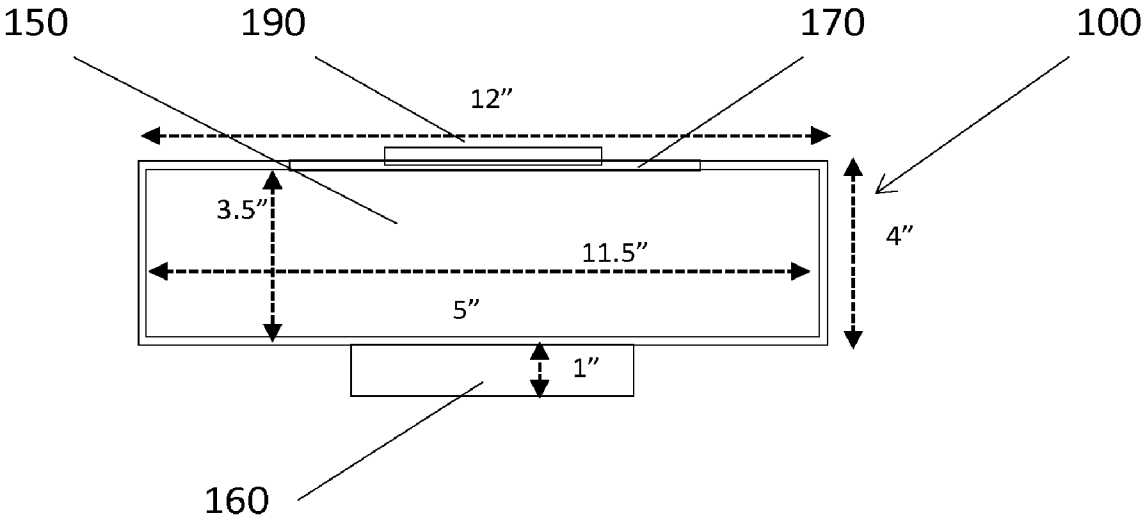
Figure 14B:
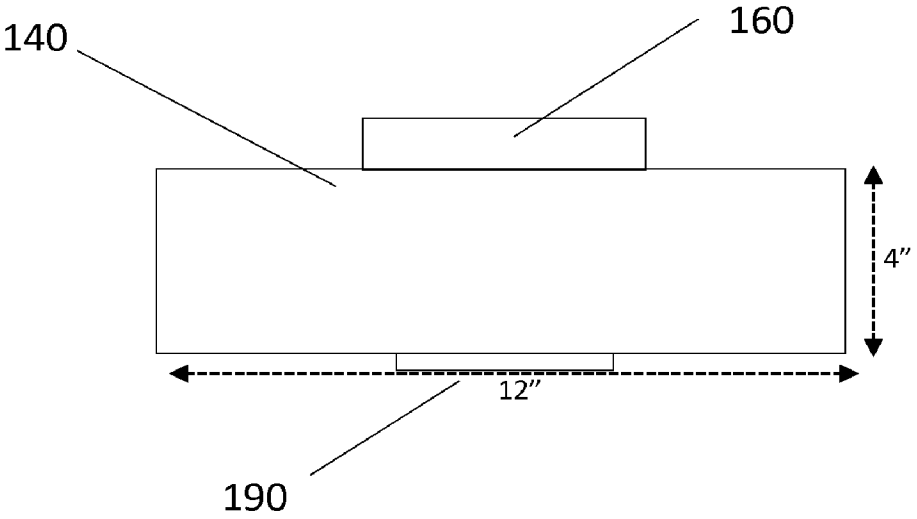

The apparatus 100 may be any suitable size. For example, the front surface 110 may range from 5-20 inches wide and 5-20 inches tall. In at least one embodiment, as shown in FIGS. 2*b* and 9*b*, the front surface 110 is approximately 12 inches wide and 12 inches tall. The back surface 120 may range from 5-20 inches wide and 5-20 inches tall. In at least one embodiment, as shown in FIGS. 3*b* and 10*b*, the back surface 120 is approximately 12 inches wide and 12 inches tall. The side surfaces 130 may range from 1-10 inches wide and 5-20 inches tall. In at least one embodiment, as shown in FIGS. 4*b* and 11*b*, the side surfaces 130 are approximately 4 inches wide at their widest and 12 inches tall. In another example, the side surfaces 130 can be approximately 5 inches wide at their widest and 15 inches tall. The bottom surface 140 may range from 1-10 inches wide and 5-20 inches long. In at least one embodiment, as shown in FIGS. 7*b* and 14*b*, the bottom surface 140 is approximately 4 inches wide and 12 inches long. The orifice may range from 2-10 inches wide and from 5-20 inches long. In at least one embodiment, as shown in FIGS. 6*b* and 13*b*, the orifice 150 is approximately 3.5 inches wide and 11.5 inches long. In another example, the orifice can be approximately 4.5 inches wide and 11.5 inches long.

The mounting hook 160 may range from 5-20 inches wide, 2-10 inches tall, and may protrude outwardly from the back surface 130 by 0.1-5 inches, for example, 0.25-5 inches. In at least one embodiment, as shown in FIGS. 3*b*, 4*b*, 10*b* and 11*b*, the mounting hook is approximately 5 inches wide, 5 inches tall and protrudes outwardly from the back surface 130 approximately 1 inch. The gap between the hook and the surface of the bag can be approximately 0.5 inch. In another example, the mounting hook can be approximately 10 inches wide, 5.5 inches tall and can protrude outwardly from the back surface approximately 1.5 inch. The handles 170 (or handle) may extend across the front surface 110 or back surface 120 in the range of 5-20 inches, for example, 5-10 inches. In at least one embodiment, as shown in FIGS. 2*b* and 9*b*, the handles 170 may extend approximately 8 inches across the front surface 110 or back surface 120. In another example, the handle may extend approximately 7 inches across the front surface 110 or back surface 120. The handles 170 may range from 0.25-10 inches wide, 0-10 inches above the top of the front surface 110 or back surface 120, and may include an opening that ranges from 1-10 inches above the front surface 110 or back surface 120. In another example, the handles may range from 0.25-3 inches wide, 1-8 inches above the top of the front surface or back surface, and may include an opening that ranges from 1-8 inches above the front surface or back surface. In at least one embodiment, as shown in FIGS. 2*b* and 9*b*, the handles are approximately 1 inch wide, extend approximately 3 inches above the top of the front surface 110 or back surface 120, and form an opening of approximately 2 inches above the front surface 110 and back surface 120. In another example, the handles can be approximately 1 inch wide, extend approximately 4 inches above the top of the front surface or back surface, and form an opening of approximately 3 inches above the front surface and back surface.

To use the apparatus 100, empty bags can be placed in the orifice 150 of the apparatus 100. The apparatus 100 may be used to store the bags in your home. To transport the apparatus 100 and bags, the handles 170 may be grasped and carried to a vehicle. The apparatus 100 may then be attached to the map/magazine/seat pocket on the seat of a vehicle. The mounting hook 160 is configured to be received by the map/magazine/seat pocket. To remove the apparatus 100 from the map/magazine/seat pocket, the handles may be grasped and the apparatus 100 may be transported into a store. The apparatus 100 may be attached to a shopping cart or shopping basket in the store or to the type of shopping cart owned by the consumer and brought to the store. The mounting hook 160 is configured to securely attach to an edge of a shopping cart or shopping basket. The bags may be removed from the apparatus 100 at the check-out or the apparatus may be handed to the cashier so the cashier can remove the bags from the apparatus. The customer or the cashier may remove the bags from the apparatus 100 and put the groceries or shopping items in the bag. The apparatus 100 may then be transported back to the vehicle or home after use in the store.

Referring to FIGS. 9*a*, 9*b*, and 11*a*-14*b*, the holder 190 may range from 1-20 inches wide, 1-20 inches tall, and may protrude outwardly from the back surface 130 or any other surface by 0.1-6 inches.

Variations and modifications of the foregoing are within the scope of the present invention. For example, one of skill in the art will understand that multiples of the described components may be used in stores and in various configurations. The present invention is therefore not to be limited to a single system, depicted in the Figures, as the system is simply illustrative of the features, teachings and principles of the invention. It should further be understood that the invention disclosed and defined herein extends to all alternative combinations of two or more of the individual features mentioned or evident from the text and/or drawings. All of these different combinations constitute various alternative aspects of the present invention. The embodiments described herein explain the best modes known for practicing the invention and will enable others skilled in the art to utilize the invention.

What is claimed is:

1. An apparatus comprising:

a front surface;

a back surface;

two side surfaces;

a bottom surface, the bottom surface being flat such that the apparatus stands on a flat surface on its own on the bottom surface;

a pair of handles, one handle extending from a top edge of the front surface and one handle extending from a top edge of the back surface; and a mounting hook attached to the back surface extending across a portion of the back surface and projecting outwardly from the back surface and extending downwardly, wherein the apparatus is configured to store bags and the front surface, the back surface, the two side surfaces, and the bottom surface are rigid.

2. The apparatus of claim 1 wherein the bottom surface has dimensions that allow the apparatus to stand freely.

3. The apparatus of claim 1, wherein the mounting hook is positioned near the top edge.

4. The apparatus of claim 1, further comprising one or more viewing windows or openings.

5. The apparatus of claim 1, further comprising an area on the front surface to display advertisements, to hold paper, to hold recipes or coupons, to hold shopping list, to hold a writing utensil, or to provide a writing surface for shopping or grocery lists or other notes.

6. An apparatus comprising:

a front surface;

a back surface;

two side surfaces, each side surface connecting the front surface to the back surface;

a bottom surface connected to the front surface, the back surface, and the two side surfaces;

a pair of handles, one handle extending from a top edge of the front surface and one handle extending from a top edge of the back surface; and a mounting hook attached to the back surface, wherein the mounting hook extends across a portion of the back surface and projects outwardly from the back surface and includes a portion that extends downwardly and is configured to be removably mounted to an object and the bottom surface being flat such that the apparatus stands on a flat surface on its own on the bottom surface, wherein the mounting hook extends across at least a portion of the back surface, wherein the back surface, side surfaces, and front surface form an orifice at a top portion, and wherein the apparatus is configured to receive bags through the orifice and the front surface, the back surface, the two side surfaces, and the bottom surface are rigid.

7. The apparatus of claim 6, wherein the bottom surface is flat such that the apparatus stands on a flat surface on its own.

* * * * *